United States Patent [19]

Moscatelli

[11] 4,262,505

[45] Apr. 21, 1981

[54] HEMISPHERICAL LOCK CYLINDER

[76] Inventor: Anthony Moscatelli, c/o Big Key Corp., 239 N. Queens Ave., Massapequa, N.Y. 11758

[21] Appl. No.: 44,796

[22] Filed: May 31, 1979

[51] Int. Cl.[3] ..... E05B 27/00

[52] U.S. Cl. ..... 70/358; 70/362; 70/364 A; 70/395; 70/417

[58] Field of Search ..... 70/350, 351, 352, 362, 70/358, 363, 364 A, 395, 417

[56] References Cited

U.S. PATENT DOCUMENTS

| | | | |
|---|---|---|---|
| 616,751 | 12/1898 | Vedden et al. | 70/364 A |
| 898,767 | 9/1908 | Mercer | 70/363 |
| 1,237,115 | 8/1917 | Stein | 70/395 |
| 2,089,300 | 8/1937 | Schlitz | 70/363 |
| 3,621,688 | 11/1971 | Asman | 70/352 |

*Primary Examiner*—Robert L. Wolfe

*Attorney, Agent, or Firm*—Jordan and Hamburg

[57] ABSTRACT

A cylinder (10) which is highly pick-resistant and also highly resistant to other means of forced entry is provided. The cylinder is of a unique hemispherical construction, involving a hemispherical shell (12), hemispherical plug (13) and hemispherical plug insert (14). In a preferred embodiment, the keyway (28) includes two keyways (23, 25). The key is of a correspondingly complex configuration including a generally circular handle portion (28) and two generally semicircular tumbler pin actuating portions (36 and 37). The hemispherical configuration and the multiplicity of keyways renders it particularly difficult to pick the lock.

5 Claims, 10 Drawing Figures

50
10
70
35
11

CYLINDER ROTATION
CAM ROTATION
70
11
10
50

50
70
10
11
KEY ROTATION 70
10
11
KEY WITHDRAWAL
50

HEMISPHERICAL LOCK CYLINDER

BACKGROUND OF THE INVENTION AND PRIOR ART STATEMENT

This invention relates to a hemispherical lock cylinder. More particularly, this invention relates to a hemispherical lock cylinder which is exceedingly difficult to pick or otherwise defeat.

All currently available lock cylinders in use operate on the general principle of a cylindrical plug rotating within a cylindrical shell. In the locked position, rotation is prevented by top pins which intrude into the shear line or separation between the plug and the shell. In order to operate the cylinder, the correctly "coded" key, i.e., that key having cuts which match the lengths of the bottom pins, is inserted such that the separation between the top and bottom pins coincides with the separation, i.e., shear line, between the plug and shell. At this point, the plug can be rotated in the shell.

The cylinder can be opened without a key by picking the cylinder, pulling out the cylinder, drilling the cylinder or punching the cylinder through the lock.

Cylinders are able to be picked because of inherent design or manufacturing induced weaknesses. The weaknesses allow the cylinder to be manipulated by picking. A pick set consists of spring steel tools which are of different shapes and spring steel tension wrenches. The wrench is inserted in the keyway, and pressure is exerted on the plug in a clockwise direction. Simultaneously, the pick is inserted in the keyway, and is used to raise the bottom pins so that the pins will reach the shearline. When all the pins have been successively raised to the shearline, the plug rotates in the cylinder and the lock is opened. Picking is possible because of a manufacturing weakness in the cylinder. When the pin chamber holes are drilled in the plug and shell, the drill bit wanders either to the right or left, top or bottom. As a result, the pin chamber holes at the shearline level will not lie perfectly on a common centerline. When tension is exerted on the plug, because the pin chambers are not exactly on center, the pins will reach the shearline at different points in the plug/plughole circumference. Picking, therefore, involves raising single pins up to the shearline to effect a bottom pin—top pin split which is held constant by the edge of the plug itself. When all the pins have met the shearline, the plug rotates and the lock opens. Since a thief cannot possibly know the "firing" or actuation order of the pins of the cylinder, it is necessary for him to move the pick in an up and down, in and out movement. The resultant up and down random movement of the pins coupled with the cylinder's drilling imperfections and the constant tension on the wrench opens the lock. If the action of the pick were analyzed with respect to the forces exerted on the pins, it would be evident that the plug is being subjected to the force of clockwise tension while simultaneously being subjected to the force of overlapping sine waves.

As mentioned before, another method of forced entry is to pull out the cylinder. In cylinders which are mounted with plain collars, the thief simply cuts and removes the collar, places vise grip pliers on the cylinder rim and wrenches the cylinder out of its mount. A screwdriver is then inserted in the hole where the cam, by means of which the cylinder actuates the lock, enters, and the lock is opened. Since the cylinder is anchored to the door with two 10–24 screws, the thief has only to find a method of breaking the screws to defeat the lock.

Another method of pulling the cylinder is to "slap" it out with a slapper. A slapper is a tool consisting of an axially aligned handle, weight and self-tapping screw head. When a "wrench proof" collar is employed, i.e., one that cannot be cut or which turns freely when a pliers is put on it, the thief simply screws the screw end of the slapper into the keyway, and shears the pins by slamming the weight against the handle. The plug, which is attached to the cam, comes out and the lock can then be opened with a screwdriver.

As mentioned above, yet another method of forced entry is to drill the cylinder. A hole is drilled at the shearline which destroys both sets of pins and allows a screwdriver to be placed in the keyway to turn the lock.

Finally, punching the cylinder through the lock is by far the most violent method of defeating a lock. Since most locks are fastened to doors from one side, it is possible to place a bar, i.e., cold chisel, to the cylinder face and punch it through the lock body itself. The lock body then just swings freely, allowing entry.

Characteristically, cylinders have been designed to mate with existing equipment, as evidenced by the fact that the external dimensions of the Leubbers cylinder, patented in 1896, are the same as those in use today. Additionally, all the cylinders in use today involve the eccentric rotation of a cylindrical solid within a cylindrical solid. Further, each cylinder has been designed to frustrate one or two methods of forced entry, while leaving the lock mechanism vulnerable to alternate methods of forced entry. Thus, a Medeco brand cylinder, probably the best available prior to the present invention, while being drill and pick resistant, can be pulled or punched.

For the purpose of making lock cylinders more pick resistant, complex keys and keyways for manipulation of plural sets of pins have been suggested in the prior art, such as U.S. Pat. Nos. 570,032; 1,500,883; 2,166,690; 2,197,673; 2,318,887; 2,620,649; 3,167,943; and 3,938,358. The fact of the matter is, however, that even with such more complex locks, picking devices need merely be inserted linearly into the keyways and there manipulated in the manner hereinbefore described.

Accordingly, it is an object of the present invention to provide a lock cylinder which is particularly pick resistant and which is, also, resistant against being defeated by pulling, drilling or punching.

It is a further object of the present invention to provide a novel key blank and the resultant keys cut therefrom for operating the novel lock cylinder of the present invention.

Other objects and advantages of the invention will be apparent from the following description thereof.

SUMMARY OF THE INVENTION

According to the invention, there is provided a lock cylinder in which the plug and shell are of a hemispherical configuration rather than a cylindrical configuration. The key blanks and keys are of correspondingly equally novel configurations.

The hemispherical lock cylinder comprises a hemispherical shell, a hemispherical plug received in the hemispherical shell, the interface of the shell and the plug constituting a shearline, a plurality of radial pin chambers formed in the shell and in the plug, each of the pin chambers in the shell being aligned with a respective pin chamber in the plug, an outer pin having an outer end portion thereof in each of the respective pin chambers in the shell, respective spring means urging each said outer pin inwardly, an inner pin having an inner end portion thereof in each of the respective pin chambers in the plug, the inner end of each of the outer pins abutting against the outer end of each of the respective inner pins within the respective plug pin chambers for the latter, each of the outer pins traversing the shearline and, thus, blocking rotation of the plug within the cylinder, and a keyway formed in the plug having outer boundaries intersecting the inner ends of the respective plug pin chambers, the keyway being adapted to receive the key having cuts so dimensioned as to move and hold each inner pin outwardly so that the abutment of each inner pin with the respective outer pin coincides with the shearline whereby the plug is rotatable in the shell by means of the key thereby to open or close a lock to which the plug is operatively connected. The shell and plug pin chambers generally include at least one set thereof with each member of the set being arranged with the intersection of its axis and the keyway situated in a plane parallel to the axis of the hemispherical lock cylinder. Preferably, the shell and plug pin chambers include a second set thereof with each member of the set arranged with the intersection of its axis and the keyway situated in a second plane parallel to the axis of the hemispherical lock cylinder. Each of the aforementioned sets may be referred to as being "paracentric" to the other set.

The key blank comprises three circular arcuate members joined together and being situated in respective parallel planes, one of the members being adapted for use as the grip of the key and the respective members on opposite sides thereof being adapted for cutting for actuation of a hemispherical lock cylinder. The key is simply the key blank with the aforementioned two members now being cut in accordance with the pins configuration of the hemispherical lock cylinder to be actuated.

BRIEF DESCRIPTION OF THE DRAWINGS

FIGS. *4a, 4b, 4c, 4d, 4e* and *4f* are a series of isometric views of the hemispherical lock cylinder according to the invention and a key according to the invention showing in consective steps operation of the cylinder by means of the key.

DETAILED DESCRIPTION OF A PREFERRED EMBODIMENT

Figure 1:
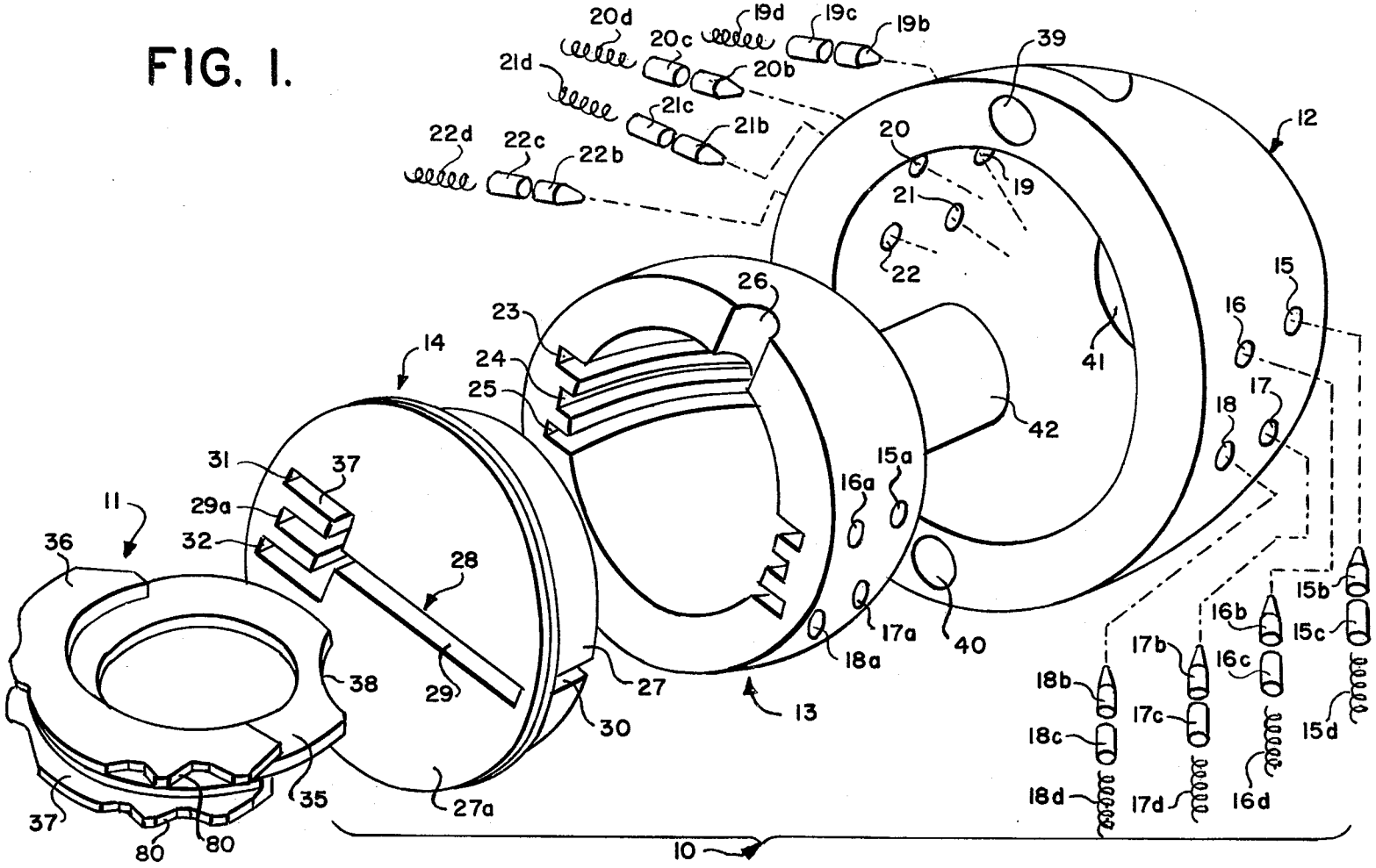
FIG. 1 is an exploded view of a hemispherical lock cylinder according to the invention.

A hemispherical lock cylinder 10 and key 11 therefor are shown in exploded isometric view in FIG. 1. The hemispherical lock cylinder consists fundamentally of a hemispherical shell 12 and a hemispherical plug. The hemispherical plug consists of a hemispherical plug proper 13 and a hemispherical plug insert 14.

The shell 12 has 8 identical pin chambers 15, 16, 17, 18, 19, 20, 21 and 22 formed therethrough. Through the plug proper 13 are formed in axial alignment with the aforementioned pin chambers corresponding pin chambers 15*a*, 16*a*, 17*a*, 18*a*, and so forth (the remaining four chambers not appearing due to the angle at which the plug proper 13 is illustrated).

Each of the aligned pairs of pin chambers 15, 15*a;* 16, 16*a;* 17, 17*a;* and so forth is provided with a respective set of inner pin, outer pin and spring, namely inner pin 15*b*, outer pin 15*c* and spring 15*d;* inner pin 16*b*, outer pin 16*c*, and spring 16*d;* inner pin 17*b*, outer pin 17*c* and spring 17*d;* inner pin 18*b*, outer pin 18*c* and spring 18*d;* inner pin 19*b*, outer pin 19*c* and spring 19*d;* inner pin 20*b*, outer pin 20*c* and spring 20*d;* inner pin 21*b*, outer pin 21*c* and spring 21*d;* and inner pin 22*b*, outer pin 22*c* and spring 22*d*. The inner end portion of each inner pin is received in the respective pin chamber in the plug proper 13. The outer end of each outer pin is received in a respective pin chamber in the shell 12. Also received in the pin chambers of the shell 12 are the springs which press the outer pins inwardly into abutment against the inner pins. The outer pins traverse between shell 12 and the plug proper 13, making impossible rotation of the plug in the shell.

Figure 5:
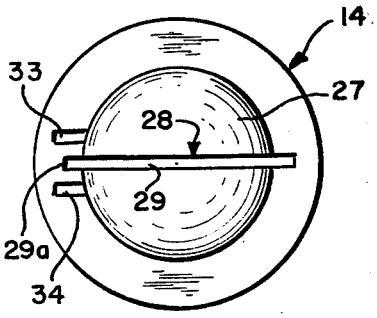
FIG. 5 is a plan view of the rear face of the plug insert of the lock cylinder according to the invention.

The keyway includes three semicircular parallel grooves 23, 24 and 25 formed in the internal hemispherical face of the plug proper 13. A semicylindrical notch 26 is formed through the periphery of the wall of the plug proper 13 on an axis at right angles to the respective planes of the grooves 23, 24 and 25. The purpose of the notch 26 is simply to permit entry of the shaft of a milling machine in order to form the grooves 23, 24 and 25. The respective inner extremities of the pin chambers 17, 18, 21 and 22 intersect the base of the keyway groove 25 while the inner extremities of the respective pin chambers 15, 16, 19 and 20 intersect the base of the keyway groove 23. The balance of the keyway is formed in the plug insert 14. The plug insert 14 includes a disc shaped portion 27*a* integral with a hemispherical portion 27. On the face of the disc 26 is formed the keyway entrance 28. The configuration of the keyway entrance 28 is rather like a trident. The "handle" 29 and "central tooth" 29*a* of the trident constitute the entry of a slot 30 dividing the hemisphere 27 in half. The other two "teeth" 31 and 32 of the trident are the respective entries of two slots 33 and 34 passing through the annular zone of the disc 26 surrounding the hemisphere 27 (FIG. 5). The slots 33 and 34 communicate with the grooves 23 and 25, respectively, and the slot 30 communicates with the groove 24. The respective end extremities of the trident "handle" 29 and trident "central tooth" 29*a* constitute the entries of slots passing through the aforementioned annular portion of the disc 26 and mating with the end openings of the groove 24.

The key 11 consists of a central handle portion 35 and two operating portions 36 and 37, fastened to the opposite sides thereof. A notch 38 is formed at an asymetrical location in the handle 35 in order to assist the user in remembering the correct orientation of the key for opening the lock of the invention. The portion 35 extends 360° while the portions 36 and 37 extend about 180°.

Other features of the hemispherical lock cylinder of the invention are analogous to features of conventional lock cylinders. In this vein, the following features are mentioned. Bores 39 and 40 are formed through diametrically opposed locations of the shell 12 for the mounting of the lock cylinder on a plate. An axial bore 41 is formed through the back wall of the shell 12. Axially mounted on the exterior of the rear wall of the plug proper 13 is a cam shaft 42. The cam shaft 42 extends through the bore 41. Received on the end of the cam shaft 42 is a cam for opening and closing the bolt of a conventional lock.

Figure 2:
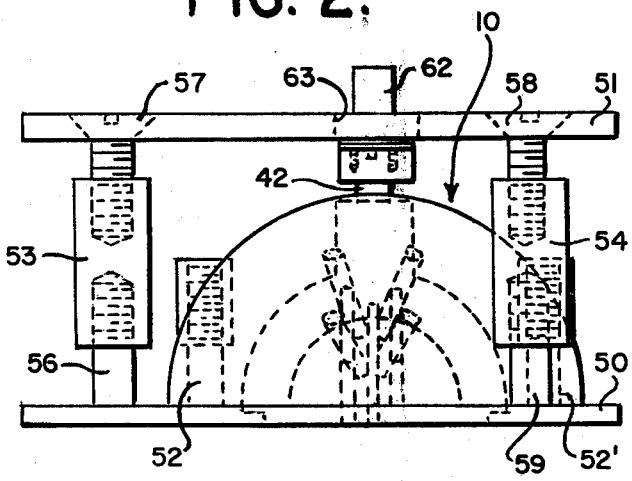
FIG. 2 is a plan view of the hemispherical lock cylinder of FIG. 1 mounted between front and rear support plates.
Figure 3:
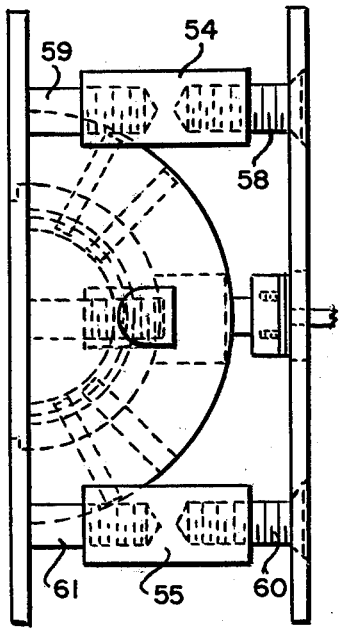
FIG. 3 shows the same combination as in FIG. 2, but in side elevation.

The hemispherical lock cylinder 10 is mounted between a front plate 50 and a rear plate 51. Screws 52 and 52' received through bores 39 and 40 in the shell 12 fasten the cylinder to the front plate 50. Bolt 56, together with screw 57, both received in bushing 53, bolt 59 together with screw 58, both received in bushing 54, bolt 61 together with screw 60, both received in bushing 55, and a like fourth set of bolt, screw and bushing near the fourth corner of the plates 50 and 51 (not visible in FIGS. 2 and 3), fasten the plates 50 and 51 together. A tail piece 62 is mounted on the cam shaft 42, and bore 63 through the plate 51 permits the tail piece 62 to rotate therein. A conventional bolt-actuating cam is mounted on the tail piece 62.

Figure 4A:
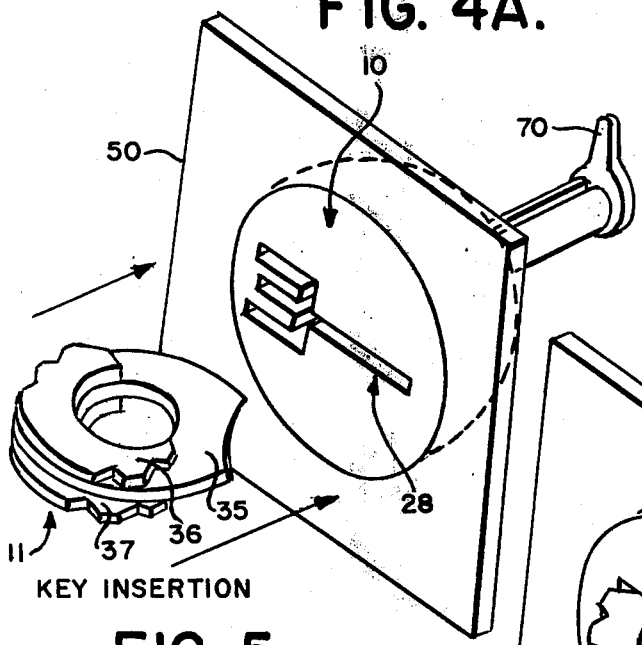
Figure 4B:
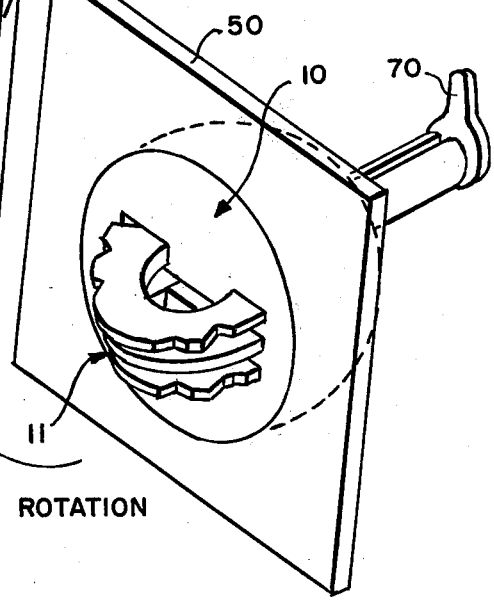
Figures 4C, 4D, 4E, 4F:
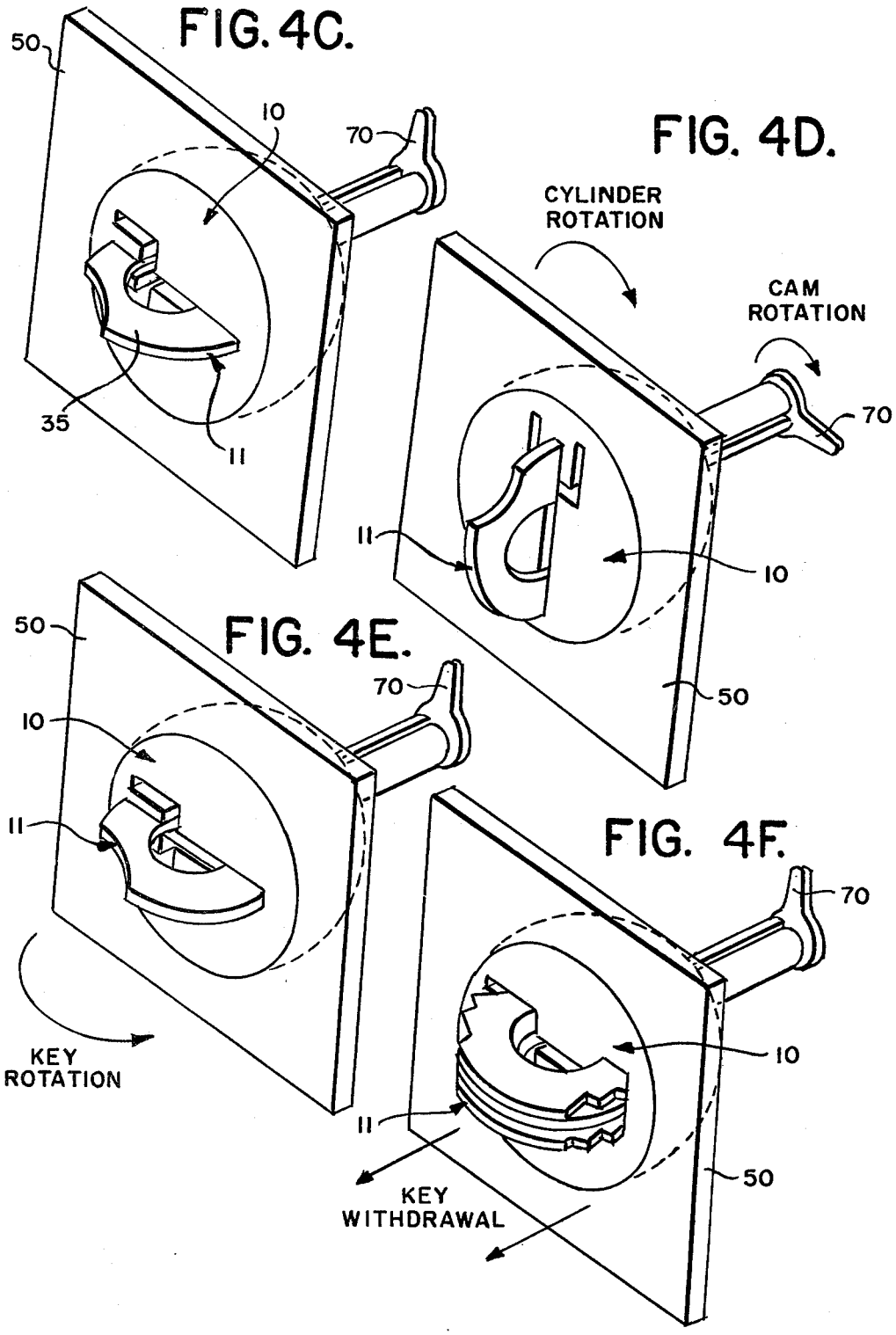

The cam 70 is shown in FIGS. 4*a* to 4*f*, which illustrate the sequence of operation of the cylinder of the invention by means of the key of the invention. The operating portions 36 and 37 of the key 11 are provided with cuts 80 for operating the pins. In FIG. 4*a*, the key 11 is inserted into the keyway 28 in an orientation such that the operating portions 36 and 37 of the key 11 are exposed (FIG. 4*b*). The key is then rotated in the planes of its own members 35, 36 and 37 180° clockwise until only the handle 35 is exposed (FIG. 4*c*). Now, by means of gripping and rotating the handle 35, the cylinder 10 is rotated clockwise about its axis 180° (FIG. 4*d*). The consequent 180° clockwise rotation of the cam 70 locks the bolt (unillustrated). Then, the key handle 35 and with it the cylinder 10 are rotated 180° in the counterclockwise direction (FIG. 4*e*) and the key 11 is rotated counterclockwise 180° in its own planes (FIG. 4*f*) to permit it to be removed. Rotation of the cylinder for locking and unlocking of the lock are exactly the same as in the case of a conventional cylinder.

With reference to the specific details of a particular, preferred embodiment, the advantages of the invention will now be further described.

Since conventional cylinder dimensions are not a factor in the design of the present invention, the length of the keyway is 4.51 inches. This contrasts to the longest available commercial keyway of 1.56 inches. Consequently, a pick has to be controlled over a length almost three times greater than was heretofore necessary. In addition, since there are in the keyway of the invention effectively two keyways, an intruder would have to manipulate two picks simultaneously over this longer distance while also maintaining tension on the cylinder with some form of wrench. A force analysis of the pins in the cylinder shows that all 8 pins need to be picked simultaneously in order to achieve rotation. An additional obstacle is presented by the fact that no pick exists which can enter the keyway and touch all 8 pins simultaneously. If such a pick were made, it would of course have to be hemispherical in shape, and the picking motion would have to be circular, and toward the intruder, rather than toward the lock. The motion would involve two hemispherical picks working at a separation of 25°, and one tension wrench exerting a clockwise force on the cylinder. This cannot be accomplished by one person.

Since the cylinder is actually part of a $\frac{1}{4}'' \times 4''$ square hardened steel plate, an intruder must remove the plate in order to pull the cylinder. The outer plate is backed by an inner plate which can be actually tied into a lock body, thereby completely bypassing the currently relied upon wooden door construction. The two plates are fastened together by $4\frac{1}{4}'' \times 20$ steel bolts, so prying the plate off is nearly impossible. In addition, since the plug insert is located behind the plate, slapping is impossible. Moreover, the hardened keyway will break slapper screws inserted in it.

The cylinder is drill resistant. The construction of case hardened steel for the plate and plug insert presents the would-be intruder with an almost drill proof lock. The pins are located along a hemispherical circumference, rendering drilling impossible.

The fact that the cylinder is 3" in diameter and combined with two 4"steel plates, obligates the intruder to attempt to punch a 3" cylinder through a 4" plate, which is quite impossible.

While the invention has been described with reference to a specific, preferred embodiment thereof, it is to be understood that the hereto appended claims, which define the scope of the invention, are also intended to include all obvious modifications and variations thereof.

What I claim is:

1. A hemispherical lock cylinder comprising a hemispherical shell, a hemispherical plug received in the hemispherical shell, the interface of the shell and the plug constituting a shearline, a plurality of radial pin chambers formed in the shell and in the plug, each of the pin chambers in the shell being aligned with a respective pin chamber in the plug, an outer pin having an outer end portion thereof in each of the respective pin chambers in the shell, respective spring means urging each said outer pin inwardly, an inner pin having an inner end portion thereof in each of the respective pin chambers in the plug, the inner end of each of the outer pins abutting against the outer end of each of the respective inner pins within the respective plug pin chambers for the latter, each of the outer pins traversing the shearline and, thus, blocking rotation of the plug within the cylinder, and a keyway formed in the plug having outer boundaries intersecting the inner ends of the respective plug pin chambers, the keyway being adapted to receive a key having cuts so dimensioned as to move and hold each inner pin outwardly so that the abutment of each inner pin with the respective outer pin coincides with the shearline whereby the plug is rotatable in the shell by means of the key thereby to open or close a lock to which the plug is operatively connected.

2. A lock cylinder according to claim 1, in which said shell and plug pin chambers include a set thereof each arranged with the intersection of its axis and the keyway situated in a plane parallel to the axis of the hemispherical lock cylinder.

3. A lock cylinder according to claim 2, in which said shell and plug pin chambers include a second set thereof each arranged with the intersection of its axis and the keyway situated in a second plane parallel to the axis of the hemispherical lock cylinder.

4. A key blank comprising three circular arcuate members joined together and being situated in respective parallel planes, one of the members being adapted for use as the grip of the key and the respective members on opposite sides thereof being adapted for cutting for actuation of a hemispherical lock cylinder.

5. A key comprising three circular arcuate members joined together and being situated in respective parallel planes, one of the members being adapted for use as the grip of the key and the respective members on opposite sides thereof having cuts formed therein for actuation of a hemispherical lock cylinder.

* * * * *